United States Patent [19]

Copeland

[11] 4,075,880

[45] Feb. 28, 1978

[54] MACHINE FOR CONTINUOUSLY COLD WORKING STEEL BAR

[75] Inventor: William Raeburn Copeland, Johannesburg, South Africa

[73] Assignee: Reinforcing & Allied Industries (Proprietary) Limited, Johannesburg, South Africa

[21] Appl. No.: 741,410

[22] Filed: Nov. 12, 1976

[30] Foreign Application Priority Data

Nov. 14, 1975 Australia ..... 3970/75

[51] Int. Cl.[2] ..... B21F 7/00

[52] U.S. Cl. ..... 72/64; 72/371; 140/149

[58] Field of Search ..... 140/149; 72/64, 65, 72/371

[56] References Cited

U.S. PATENT DOCUMENTS

| | | | |
|---|---|---|---|
| 1,823,424 | 9/1931 | Conner | 140/149 |
| 1,934,122 | 11/1933 | Hill | 140/149 |
| 2,280,500 | 4/1942 | Reyburn | 140/149 |

*Primary Examiner*—Lowell A. Larson

*Attorney, Agent, or Firm*—Oblon, Fisher, Spivak, McClelland & Maier

[57] ABSTRACT

A method and apparatus for cold working steel lengths on a continuous basis so as to impart the cold working properties to the steel. The steel is twisted and immediately untwisted so as to impart torsional force into the steel. Tensile forces are also imparted simultaneously into the steel.

9 Claims, 7 Drawing Figures

MACHINE FOR CONTINUOUSLY COLD WORKING STEEL BAR

Figure 1:
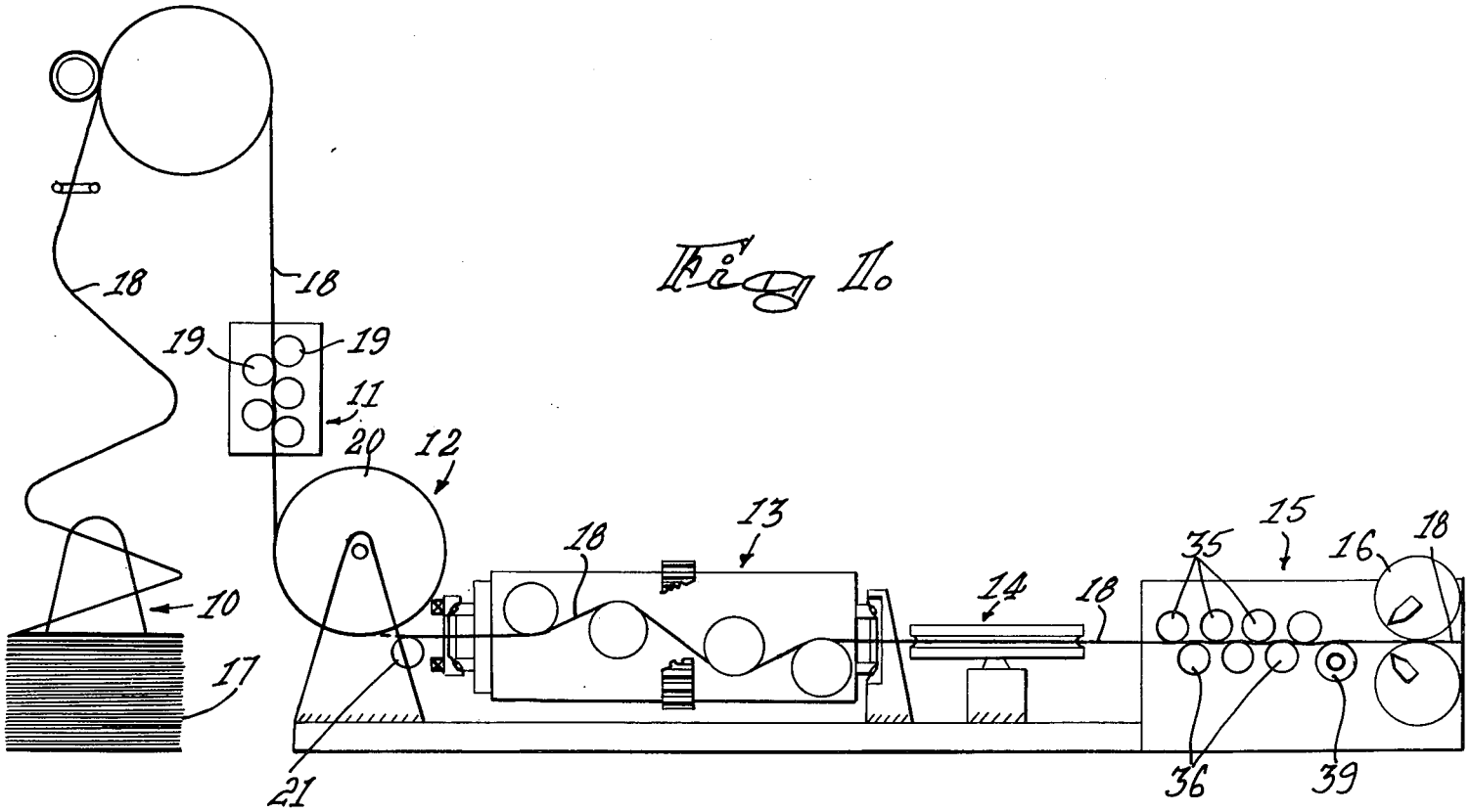

This invention relates to a method for cold working steel lengths on a continuous basis. The invention also relates to a machine for carrying out the method and to a product so obtained.

In particular the invention is directed to a manner of obtaining in bars, rods or wires the properties of a cold worked product, which properties are imparted to the steel on a continuous basis as it feeds through a machine.

The properties of cold worked steel are well-known and are imparted extensively to steel in finite lengths, such steel being used particularly in the concrete reinforcing steel industry. It has been conventional practice to cut steel lengths to particular lengths and thereupon twist or impart torsional or tensional force to the steel to obtain the characteristics of a cold worked steel in each particular length at a single time. This procedure is necessarily time consuming, labour intensive and accordingly costly.

It is an object of the invention to provide a procedure for continuously applying a torsional force to elongated steel lengths in a manner which the applicant believes will minimize the problems previously encountered.

According to the invention a method of cold working steel by imparting a torsional force to an elongated steel length includes the steps of feeding the elongated length into a first gripping formation, such gripping formation restraining the steel length from rotating about an axis along its line of feed, feeding the elongated length into a second gripping formation, causing the second gripping formation to rotate about an axis substantially axially aligned to the line of feed thereto of the elongated steel length, and continuously feeding the length through the gripping formations thereby to cause the second gripping formation to impart continuously a requisite degree of torsion to the steel length.

Further according to the invention the steel is fed from the second gripping formation to a third gripping formation downstream from the second gripping formation, such third gripping formation acting continuously at least partially to counter the torsional force imparted to the steel length.

In some preferred forms of the invention a tensional force is imparted to the steel upstream the second gripping formation. In some preferred forms of the invention a tensional force may be applied downstream the third gripping formation.

Also according to the invention the first and third gripping formations act to change the direction of travel of the steel length through an arc relative to the direction of travel into and from the second gripping formation.

The invention also covers within its scope apparatus for imparting a torsional force to an elongated steel length including feed means for the steel, a first gripping formation, such formation acting to restrain the steel length from rotating about an axis along the line of feed, a second gripping formation for receiving steel from the first formation such second formation being rotatable about an axis substantially axially aligned relative to the line of steel feed thereto, the rotational speed being predetermined relative to the feed speed thereby to impart a requisite degree of torsional force to the steel.

In a preferred form of the invention a third gripping formation is provided downstream the second gripping formation, such third gripping formation acting at least partially to counter the torsional force.

Preferably the second gripping formation is defined by one or more pairs of pulleys located to accomodate between their pairs the steel profile undergoing torsion.

In some forms of the invention at least two sets of pulley pairs define the second gripping formation, the pairs being offset relative to the line of feed of the steel length such as to impart set or eccentricity to the steel.

In a further preferred form of the invention the first and third gripping formations are defined by pulley systems rotational about an axis substantially transverse to the line of feed of the steel length.

Figure 2:
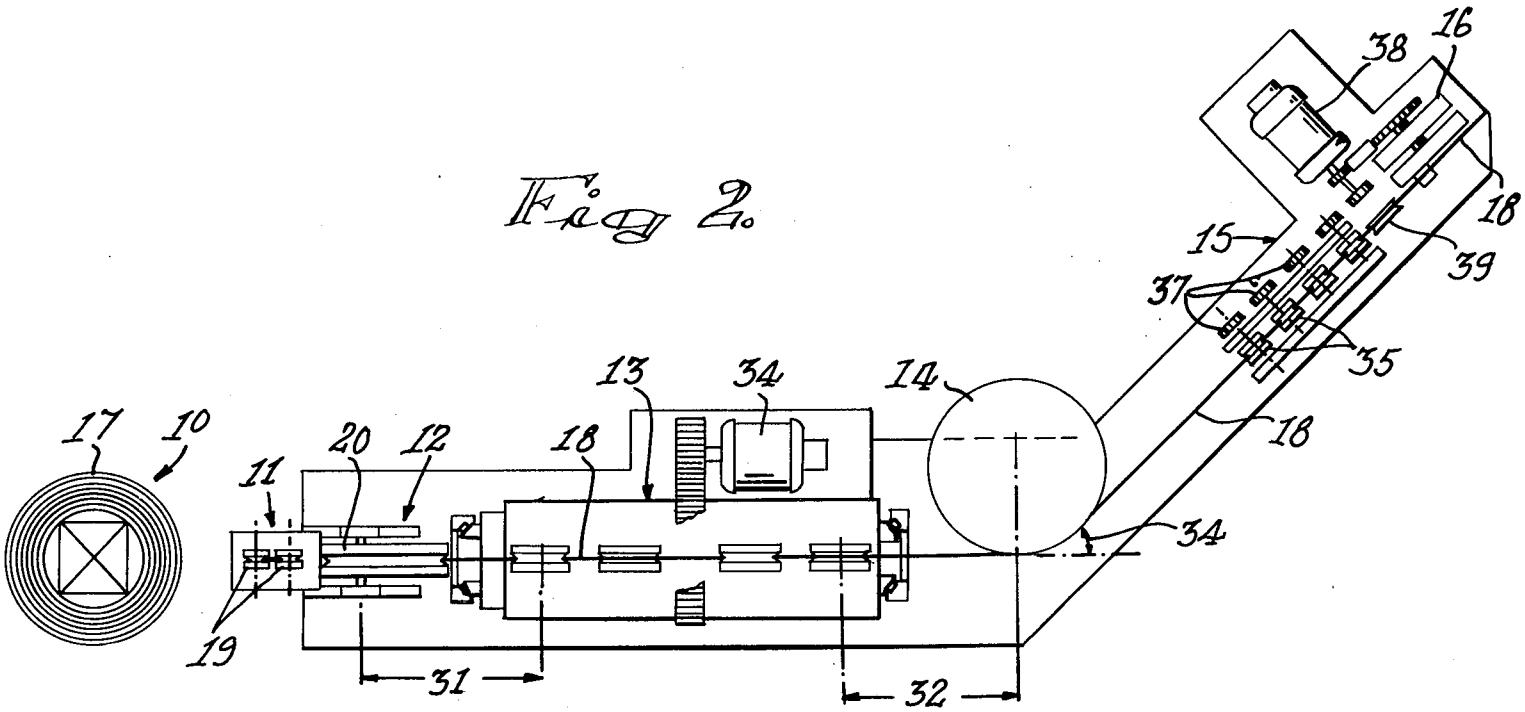
Figure 4:
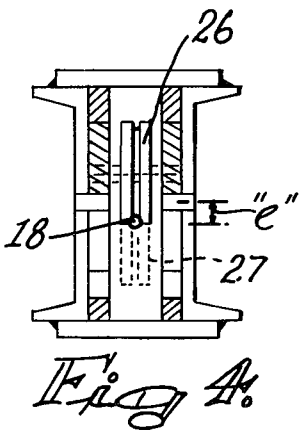
Figure 5:
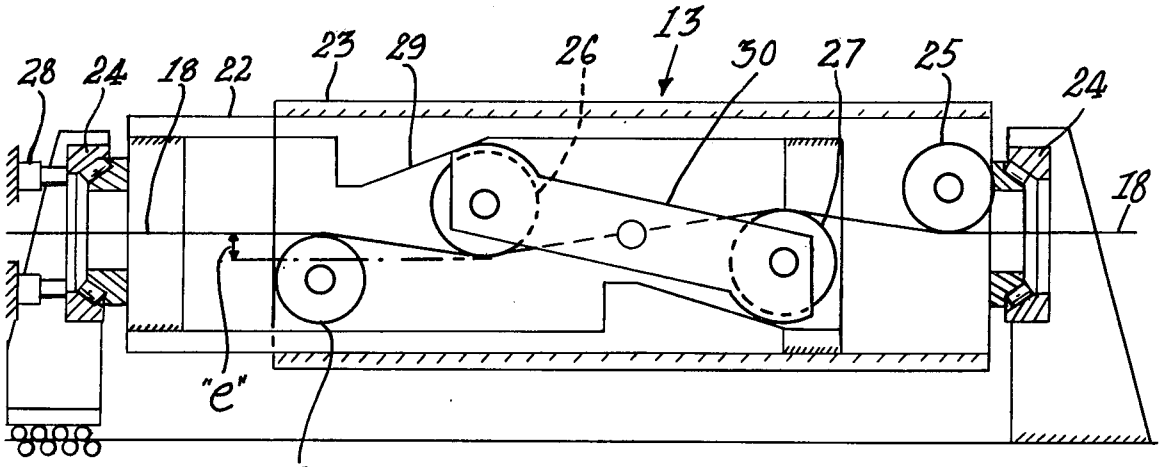
Figure 5:
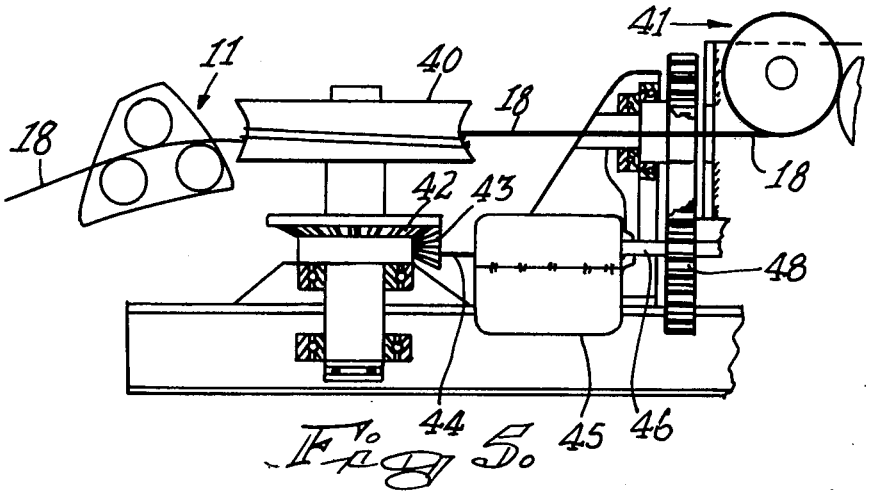
Figure 6:
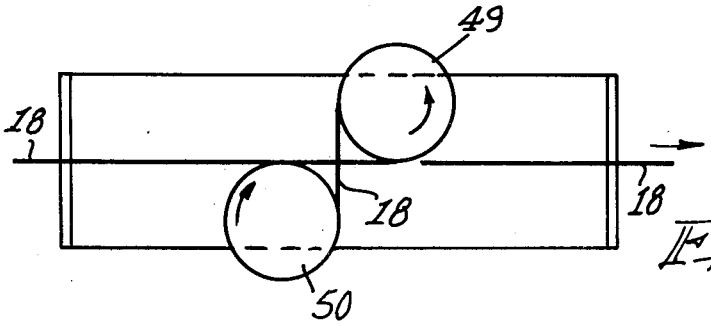
Figure 7:
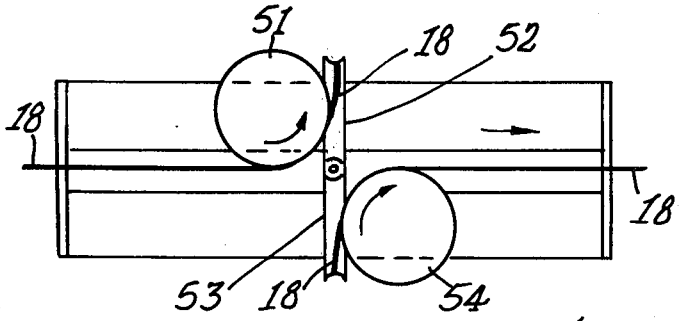

The invention is now further described with reference to the accompanying substantially diagrammatic drawings, the drawings being:

FIG. 1: a side elevation of apparatus for cold working steel, the steel being illustrated from the feeding point to the end point;

FIG. 2: a view of the apparatus as illustrated in FIG. 1;

FIG. 3: an enlarged side elevation of the torsioning unit of the cold working apparatus;

FIG. 4: a sectional end elevation of the unit illustrated in FIG. 3;

FIG. 5: a partial view side elevation of an alternative feed to the torsioning unit of the apparatus;

FIG. 6: a diagrammatic side elevation of an alternative pulley system within the torsioning unit; and FIG. 7: a diagrammatic side elevation of a further alternative pulley system of the torsioning unit.

Referring to the drawings the apparatus can basically be defined as a decoiler unit 10 which feeds the steel length to a primary straightening and tensioning unit 11, which in turn feeds a guide pulley system 12, the output of which feeds the steel length to the cold working head 13 in which a torsion force is imparted to the steel, a pulley arrangement 14 for guiding the steel from unit 13 and assisting in creating the torsional forces imparted to the steel, the output from the pulley system 14 being fed into a drive mechanism 15, the output of which provides a shearing mechanism 16.

The decoiler unit 10 is a device which allows elongated lengths of steel in the form of coils rods, bars or wires to be fed from either stationary or rotating coils 17 to a primary straightening and tensioning unit 11.

Where the decoiler 17 feeds from stationary coils of elongated steel subsequent coils can be butt welded to the trailing end of a leading coil without the necessity of stopping the decoiler 17 and the subsequent apparatus of the invention. A rotating decoiler will allow coils to rotate and pay the elongated steel feed straight off the decoiler. A disadvantage, however, is that butt welding of subsequent coils becomes more difficult without stopping the apparatus of the invention.

Elongated steel lengths are fed to a primary straightener and tensioning device 11 which is constituted by a number of grooved pulleys adjustable to bend, re-bend and bend again the steel length as it passes therethrough. This device effects a rough straightening of the material and provides a variable tension to the elongated steel length as indicated by numeral 18 as it passes through the straightener. The individual pulleys are each adjusted for the degree of straightening and tension required to the steel length 18. If necessary the straightener 11 can be provided with a mechanism to allow for the quick release of the pulley sets 19 thereby to allow for the easy passage of a new feed of steel 18 as required.

From the straightener 11 the steel length 18 is fed to a pulley guide 12 which is defined by an assembly of pulleys and guide pulleys 20 and 21 respectively which have the function of deflecting the steel so that it can feed into the cold working unit 13. The pulleys 20 and 21 act to resist the torsional forces which will be exerted in the cold working unit 13 into which the steel length 18 feeds. As such the pulley guide 12 constitutes the first gripping formation.

The cold working unit 13 wherein the torsional force is imparted to the steel length 18 forms the second gripping formation and is defined by an inner framework 22 and an outer framework 23 which are co-linear and telescopically disposed and capable of rotating between roller and thrust races 24 about an axis substantially in alignment with the axial feed of the elongated steel length 18 as it enters and leaves the cold working unit 13.

Grooved pulley sets are attached to the frameworks 22 and 23, two pulleys numerals 24 and 25 respectively are fixed to the framework such that the elongated steel length entering and leaving the cold working unit are co-linear with the longitudinal axis about which the cold working unit will rotate. The elongated length is deflected around these fixed pulleys 24 and 25 by adjustable pulleys 26 and 27.

The set or eccentricity "*e*" as indicated in FIG. 3 through which the steel length 18 is deflected is adjusted by moving the frameworks 22 and 23 relative to each other by means of jacks 28. This causes the wedge formations 29 to alter the degree of pivot of rotating arm 30 to which the adjustable pulleys 26 and 27 are affixed. Thus by positioning the telescoping frameworks 22 and 23 closer together in a relative sense the less removed from the horizontal will become the angle of the arm 30 and the higher will be the value of "*e*" imparted to the steel length 18. By rotating the cold working unit 13 as the steel length passes through so the length will become initially twisted by the imparting thereto of a torsional force over a distance defined by numeral 31 in FIG. 2. This distance is defined between the points where the length 18 leaves the periphery of pulley 12 and the point where length 18 meets the periphery of pulley 24. Downstream the cold working unit 13 a counter-torsional force is exerted on the elongated length 18 over the length 32 as defined in FIG. 2. Length 32 is the distance between the point where length 18 leaves pulley 25 to a point where the length 18 meets the periphery of pulley 33 downstream of the cold working unit 13. Lengths 31 and 32 are preferably equal.

Varying the speed of rotation of the cold working unit 13 with respect to the speed of longitudinal travel of the length 18 creates a requisite amount of torsional force in a given length of steel for a given diameter of steel. The rotation of the working head 14 is affected by a motor 34 which is connected through gear means 35 with the rotatable cold working unit 13.

The degree of set or eccentricity imparted to the steel length 18 is determined so as to prevent slippage of the steel length 18 during the continuous cold working operation in unit 13.

Tension is imparted into the elongated length 18 by adjusting the primary straightening and tensioning unit pulleys 19 and further tension can be imparted into the elongated length 18 by adjusting the set or eccentricity "*e*", to a level which is not so low that torsional slippage of the elongated length will occur.

The steel length 18 now enters a third gripping formation which consists of a guide pulley 33 which acts to deflect the elongated length 18 through an arc 34 relative to the direction of feed of the elongated length 18 into and from the cold working unit 13. This deflection is sufficient to prevent torsional rotation being transmitted along the elongated length 18 downstream of the pulley 33.

The drive mechanism of the apparatus consists of a series of grooved driving and straightening pulleys 35 and 36; the driving pulleys 35 are directly coupled to a train of gears 37 which are in turn coupled to a driving motor 38. The idling pulleys 36 are adjusted to transmit sufficient force to the steel length 18 to enable it to progress through the apparatus. The forces transmitted need to be sufficient to overcome the resistance of bending the steel length 18 in the tensioning device 11, the guide pulley 12 and the cold working unit 13. The tensional forces created in the elongated steel by the force which is transmitted in the driving mechanism 15 and which is resisted by the various devices 11, 20, 13 and 14 as previously described.

To increase the driving force of mechanism 15 the pulleys 35 and 36 can be arranged in balanced pair sets, all the pulley wheels being driven. In such a case a separate straightening mechanism may be required.

The driving motor 38 is preferably a variable speed motor and is coupled to the motor 34 either electrically or mechanically so as to provide a constant relationship between the rotational speed of unit 13 and the speed of longitudinal travel of the elongated length 18 for a given shape and size of steel length 18.

Once the steel length 18 has passed through the driving mechanism 15 it passes over a measuring wheel 39 and in turn through a set of shears 16 which cuts the elongated length while the elongated length 18 is moving.

There are several means of shearing the elongated length 18 to a constant length and any one of these may be used to affect measuring and operation of the shearing mechanism 16. If required variable lengths of steel may be obtained by computer connecting the various mechanisms of the shearing and measuring devices. In certain cases coils may be produced instead of shearing the ends of the elongated length.

Additional ancillary equipment may be providing to the apparatus described for automating to various degrees the collection of processed steel lengths. For instance these may be racking devices for collecting in substantially parallel fashion groups of cut and processed steel lengths. Such groups may be moved along by conveyors or the like as required. Alternatively coiling devices may provided to suitably coil processed steel.

Other alternative arrangements for the invention relate to the driving mechanism 15, and instead of the pulley system, a chain drive or a rope drive may be effectively used. A further alternative would be an electric linear induction motor drive with a static frequency convertor to obtain variable speeds. The advantage of the latter form of drive would be that there would be two moving parts associated with the driving mechanism.

Referring to FIG. 5 of the drawings there is shown an alternative feed device for creating a higher degree of tension in an elongated steel length 18 than can be achieved in the tensioning device 11 illustrated in FIGS. 1 and 2. The tensioning device of FIG. 5 is defined by a pulley wheel 40 which also acts in this arrangement as a driving mechanism for a cold working unit 41 (or in an appropriate case, unit 13). The elongated steel 18 is wound around the diameter of pulley wheel 41 for more than one turn. The surface of the pulley wheel 40 allows the steel length 18 to slip toward the minimum diameter 40 as it progresses. The contact area is sufficient to overcome friction slip and therefore transmits linear forces from the elongated steel to rotational forces in the wheel depending on the resistance provided by the wheel and the mechanism it is driving. The driving force is in fact transmitted to the elongated steel 18 by the mechanism 15 downstream the cold working unit 41.

To the pulley wheel 40 is attached a gear driving wheel 42 and driven wheel 43 which transfers the torsional force at right angles to shaft 44. A gearbox 45 allows variation in the speed of the driven end of the shaft 46 which can drive the cold working unit 41 through gearwheels 48. This replaces the drive being directly transmitted by a separate motor 34 as previously described.

If additional resistance is required in pulley wheel 40 to induce a higher force in the elongated steel 18 and additional brake (not shown) can be introduced which can be a friction type brake, an electrical generator or air-compressor type, of which the latter two can provide useful energy from the energy being destroyed in providing additional resistance to the pulley wheel 40.

Different forms of cold working units 13 or 41 may be provided to that described in detail with reference to FIG. 3 above. Additionally instead of the jacking mechanism 28 for affixing the relative angle of arm 30 compared to the line of travel of elongated length 18 alternative means may be used for locking pulleys 26 and 27 in their relatively desirable positions. Adjusting these relative positions permits a variation of the eccentricity "*e*" and this can be varied whilst the unit is in operation by adjusting jacks 28 as may be required.

In FIG. 6 there is illustrated diagrammatically a series of pulleys defining an alternative cold working head. In this arrangement the elongated steel length 18 passes over a pulley system 49 and 50 so that the steel length 18 is strained beyond the proportional limit of the steel and probably beyond its yield point. Such a strain is a tensile one on the outside of the radius of the steel length and a compressive strain on the inside. To reduce the number of times the steel is strained beyond its proportional limit in the cold working head the two pulley arrangements 49 and 50 is used such that the length passes over pulley 49 and is deflected to an angle of approximately 270° and it then passes over pulley 50 which is arranged also to cause a 270° deflection thereby causing the elongated length to form a figure of 8 arrangement.

In FIG. 7 the steel length 18 passes over pulley 51 and is strained beyond its proportional limit thereby causing a permanent set in the steel which alters its tensile characteristics. The steel rod then passes over pulley 52 and in turn on to pulley 53 and finally on to pulley 54. Pulleys 51 and 54 are set in one plane such that their axes of rotation are orthogonal to the axis of rotation of the cold working head and pulleys 52 and 53 are set in a second train whose axes are parallel to the rotational axis of the cold working unit.

In the arrangement described the steel length will pass over pulley 51 and be deflected through 90°, over pulley 52 it will be deflected through 270° and this degree of deflection will be repeated over pulley 53, and finally over pulley 54 where the degree of deflection will be 90°. Pulleys 52 and 53 are arranged to provide a positive force applied to the steel length in both the torsion and countertorsional affects being applied to the elongated steel length 18.

Other variations of the invention can take place in the guide or deflecting wheel or pulley 14 inasmuch as the angle 34 can be varied to any desirable angle so as to prevent the torsional rotation along the length 32 being transmitted downstream of the pulley wheel 14. Similarly on the upstream side of unit 13 the pulley wheel 12 prevents torsional rotation of the steel length 18, and the degree of deflection around wheel 12 is determined to effect total resistance to the torsional forces. In some cases it might be desirable for this angle to be approximately right angular and for further straightening mechanisms to be inserted between the pulley wheel 14 and the driving mechanism 15.

The apparatus and method of the invention can be used equally on elongated steel lengths 18 to cold work them whether the cross section of the lengths are circular, square, deformed, indented, rolled or otherwise drawn.

It is anticipated that the invention will provide for steel elements for reinforcing purposes in so called fabric mats and steel reinforcing in construction, where, prior to the applicant's invention, the strengthening of the steel has only been affected by manual processes on a non-continuous basis where bars are concerned, and on drawing or rolling basis where wire is concerned.

In the presently known procedures drawing and rolling have imparted the cold working properties to the steel on a continuous basis, but such operations have changed the steel properties by imparting a tensional force and not a torsional force to the steel. Drawing and rolling also have the effect of reducing the diameter of the steel and changing the surface characteristics of the steel. The applicant's arrangement does not effect the steel in this manner and the cold working properties are imparted in a manner that the steel diameter and surface characteristics of the steel lengths are substantially unchanged.

Where previously twisting or torsional forces have been imparted to wire on a continuous basis this has been for the purpose of straightening or suitably bending the wire but not for imparting the cold working properties to the wire as the applicant does in the present invention.

The applicant provides an arrangement where sufficient friction is developed on the surface of the elongated length being subjected to torsional force by effectively cranking the elongated length by inducing a positive set or eccentricity "*e*" into the length thereby reducing the torsional force necessary on the surface of the elongated length.

In the net result the applicant believes that the arrangement provided permits for a continuous automatic cold working operation, producing savings and advantages from a labour point of view. Additionally, being continuous, straight bars can be produced and cut to finite length without the generation of significant scrap.

I claim:

1. A method of cold working an elongated steel length by imparting a torsional force to such length including the steps of:

feeding the elongated length into a first gripping formation, such gripping formation restraining the steel length from rotating about an axis along its line of feed, feeding the elongated length into a second gripping formation, causing the second gripping formation to rotate about an axis substantially axially aligned to the line of feed thereto of the elongated steel length, continuously feeding the length of steel through the gripping formations thereby causing the second gripping formation to impart continuously the requisite degree of torsion to the steel length, and feeding the steel length from the second gripping formation to a third gripping formation downstream of the second formation, such third formation being non-rotatable about the axis of the line of feed and restraining the steel from rotating about an axis along the line of feed thereto of the steel length, such that relative the second and third gripping formations a rotation occurs counter the rotation between the first and second gripping formations such that between the second and third gripping formations a continuous counter torsional force is imparted into the steel length.

2. A method as claimed in claim 1 including the step of imparting a torsional force continuously to the steel length upstream and downstream of the second gripping formation.

3. A method as claimed in claim 2 including the step of imparting a tensional force continuously to the steel length substantially while a torsional force is imparted to the steel length.

4. Apparatus for imparting a torsional force to an elongated steel length including:

feed means for the steel length, a first gripping formation for receiving steel, such formation acting to restrain rotation of the steel length about an axis along its line of feed, a second gripping formation for receiving steel from the first formation, such second formation being rotatable about an axis substantially axially aligned relative to the line of the steel feed, the rotational speed being predetermined relative to the feed speed thereby to impart the requisite degree of torsional force of the steel, and a third gripping formation for receiving steel from the second formation, such third formation being non-rotatable about an axis axially aligned relative to the line of steel feed and restraining rotation of the steel length about an axis along its line of feed such that between the second and third formations a torsional force is imparted to the steel counter to the torsional force imparted between the first and second formations.

5. Apparatus as claimed in claim 4 wherein the second gripping formation is defined by one or more pairs of pulleys located to receive between them the steel profile undergoing torsion.

6. Apparatus as claimed in claim 5 wherein at least two sets of pulley pairs define the second gripping formation, the pairs being offset relative to the line of feed of the steel length thereby to impart an eccentricity to the steel.

7. Apparatus as claimed in claim 6 wherein the first and third gripping formations are defined by pulley systems rotational about an axis substantially transverse to the line of feed of the steel length, such formations acting to change the direction of travel of the steel through an arc relative to the direction of travel into and from the second gripping formation.

8. A steel length wherein a torsional force and a counter torsional force is imparted therein by the method of claim 1.

9. An elongated steel length wherein there has been imparted a torsional force and a counter torsional force by the apparatus of claim 4.

* * * * *